US007882680B2

(12) United States Patent
Siegel et al.

(10) Patent No.: US 7,882,680 B2
(45) **Date of Patent: *Feb. 8, 2011**

(54) AUTOMATED SOLID PHARMACEUTICAL PRODUCT PACKAGING MACHINE

(75) Inventors: Todd Siegel, St. Petersburg, FL (US); Stuart C. Bagley, Dunedin, FL (US); Anne M. Bagley, legal representative, Dunedin, FL (US)

(73) Assignee: MTS Medication Technologies, Inc., St. Petersburg, FL (US)

( * ) Notice: Subject to any disclaimer, the term of this patent is extended or adjusted under 35 U.S.C. 154(b) by 49 days.

This patent is subject to a terminal disclaimer.

(21) Appl. No.: 11/399,566

(22) Filed: Apr. 5, 2006

(65) Prior Publication Data

US 2007/0084150 A1 Apr. 19, 2007

Related U.S. Application Data

(63) Continuation of application No. 09/704,134, filed on Nov. 1, 2000, now Pat. No. 7,334,379.

(51) Int. Cl.
*B66B 57/00* (2006.01)
*B66B 36/30* (2006.01)

(52) U.S. Cl. ..... 53/55

(58) Field of Classification Search ..... 53/509, 53/52, 131.2, 150, 152, 153, 156, 534, 539, 53/247, 237, 240, 154, 531, 543, 55, 250, 53/139.2; 700/231

See application file for complete search history.

(56) References Cited

U.S. PATENT DOCUMENTS 1,258,012 A 3/1918 Jedel
1,993,619 A 3/1935 Neff et al.
3,456,424 A 7/1969 Thurston et al.
3,780,856 A 12/1973 Braverman
4,233,799 A 11/1980 Caille
4,416,375 A 11/1983 Braverman et al.
4,490,963 A 1/1985 Knudsen
4,546,901 A 10/1985 Buttarazzi
4,655,026 A 4/1987 Wigoda (Continued)

FOREIGN PATENT DOCUMENTS

DE 35 41 672 A1 5/1987

OTHER PUBLICATIONS

Tosho Inc.; Sales brochure for "Automatic Tablet Packing Machine BPM/CE"; Jun. 1, 1998; Japan.

(Continued)

*Primary Examiner*—Rinaldi I. Rada
*Assistant Examiner*—John Paradiso
(74) *Attorney, Agent, or Firm*—Robert J. Depke; Rockey, Depke & Lyons, LLC

(57) ABSTRACT

An automated pharmaceutical product packaging machine simultaneously fills a plurality of product package templates in parallel with desired pharmaceutical dosing requirements. The templates are subsequently positioned over a temporary storage template having cavities for receiving solid pharmaceutical doses. A collector member is subsequently placed beneath the temporary storage template for receiving the pharmaceuticals which in turn is positioned over a solid pharmaceutical product package having a plurality of cavities which correspond to openings on the templates and wherein each of the templates fills a pharmaceutical package.

11 Claims, 6 Drawing Sheets

U.S. PATENT DOCUMENTS

| | | | |
|---|---|---|---|
| 4,664,289 | A | 5/1987 | Shimizu et al. |
| 4,733,362 | A | 3/1988 | Haraguchi |
| 4,834,264 | A | 5/1989 | Siegel et al. |
| 4,844,246 | A | 7/1989 | Harrison et al. |
| 4,870,799 | A | 10/1989 | Bergerioux et al. |
| 5,019,125 | A | 5/1991 | Rebne et al. |
| 5,348,061 | A | 9/1994 | Riley et al. |
| 5,358,118 | A | 10/1994 | Thompson et al. |
| 5,481,855 | A | 1/1996 | Yuyama |
| 5,548,941 | A | 8/1996 | Portaro et al. |
| 5,658,802 | A | 8/1997 | Hayes et al. |
| 5,720,154 | A | 2/1998 | Lasher et al. |
| 5,753,456 | A | 5/1998 | Naqui et al. |
| 5,765,606 | A | 6/1998 | Takemasa et al. |
| 5,839,257 | A | 11/1998 | Soderstrom et al. |
| 5,852,911 | A | 12/1998 | Yuyama et al. |
| 6,023,916 | A | 2/2000 | Bouthiette |
| 6,170,230 | B1 | 1/2001 | Chudy et al. |
| 6,318,051 | B1 | 11/2001 | Preiss |
| 6,325,114 | B1 | 12/2001 | Bivirt et al. |
| 6,334,980 | B1 | 1/2002 | Hayes et al. |
| 6,625,952 | B1 | 9/2003 | Chudy et al. |
| 6,925,774 | B2 | 8/2005 | Peterson |
| 7,334,379 | B1 * | 2/2008 | Siegel et al. ..... 53/55 |
| 2006/0277870 | A1 | 12/2006 | Feehan et al. |

OTHER PUBLICATIONS

Medical Packaging Inc.; Sales brochure for “AutoPak BPM”; USA.

* cited by examiner

AUTOMATED SOLID PHARMACEUTICAL PRODUCT PACKAGING MACHINE

The subject matter of application U.S. patent application Ser. No. 09/704,134 is incorporated herein by reference. The present application is a continuation of U.S. patent application Ser. No. 09/704,134, filed Nov. 1, 2000 now U.S. Pat. No. 7,334,379. The present application claims priority to this previously filed application.

BACKGROUND OF THE INVENTION

1. Field of the Invention

The present invention relates generally to the field of automated pharmaceutical product packaging machines. More specifically, the present invention is directed to an automated pharmaceutical product packaging machine which simultaneously fills a plurality of product package templates in parallel with desired pharmaceutical dosing requirements. The templates are subsequently positioned over a temporary storage template having cavities for receiving solid pharmaceutical doses. A collector member is subsequently placed beneath the temporary storage template for receiving the pharmaceuticals which in turn is positioned over a solid pharmaceutical product package having a plurality of cavities which correspond to openings on the templates and wherein each of the templates fills a pharmaceutical package.

2. Description of the Related Art

There are a wide variety of automated pharmaceutical product packaging machines currently available. Many of these machines in the prior art are designed for packaging a single pharmaceutical product into a single dose package. The existing machines typically transfer individual doses into a single cavity formed within a clear plastic cover member.

Usually, a plurality of cavities are formed in a single sheet of clear plastic material and a corresponding plurality of pharmaceutical product doses are inserted by a filling machine. Once the solid pharmaceutical doses have been inserted into the cavities, a backing material is then adhesively applied to the clear plastic sheet to seal the solid pharmaceutical products within the package. These automated machines satisfy the majority of solid pharmaceutical packaging requirements where a single product is inserted into the dose package. However, it has been recognized that for managed care and other settings, there is a significant need for automated pharmaceutical packaging machines which are capable of selectively depositing one or more pharmaceutical doses into each of a plurality of individual cavities in an overall pharmaceutical product package.

Managed care facilities now use patient-specific packaging that provide all of the designated patient's prescription drug needs for a given period of time. The period of time is typically a one week or one month supply. Existing packaging solutions typically employ solid pharmaceutical product package cards that contain all of the specific patient's doses for a one week period of time. Each dose of one or more pharmaceuticals is stored in a clear plastic cavity. These dosing cards may include three to four clear plastic cavities for any given day that correspond with each prescribed dosage time for a patient's medication requirements. Alternatively, each patient may have as many as ten different product packages, each containing the dosing requirements for a given period of time.

The inventors of the present application have previously filed an application on an automated solid pharmaceutical product packaging machine which selectively fills a plurality of different dosing cavities with a plurality of different solid pharmaceutical medications for a single patient. This prior application and the referenced subject matter contained therein had overcome the shortcoming of the prior art and provided managed care facilities with the ability to create a customized package containing a specific patient's dose of solid pharmaceuticals for a given period of time. One of the shortcomings of the device of the prior application is that the available selection of pharmaceuticals for filling each of the cavities was limited by the structure of the machine described in the referenced prior application. Specifically, in the prior application, only a single package template was filled by the machine at any given period of time. In this prior machine, the feed mechanism positioned each of the respective cavities of a template under a mechanical source for solid pharmaceutical products that was fed in turn by a plurality of dispensing canisters, each respectively containing an individual pharmaceutical. This prior machine was incapable of simultaneously filling a plurality of different cavities.

As a result, the prior machine had several shortcomings. First the machine had inherent speed limitations and therefore could not fill a customized patient product package very rapidly. Additionally, depending upon the variety of pharmaceutical packages that were to be prepared by a medical institution, it might be possible that two machines would be necessary in order to fill each of a plurality of patient requirements in respective patient dosing cards. The inventors of the present application have overcome the shortcomings of the prior art and have set forth herein an improved solid pharmaceutical product packaging machine which is capable more rapidly filling a plurality of solid pharmaceutical product package dosing requirements.

SUMMARY OF THE INVENTION

The present invention is directed to an improved solid pharmaceutical product packaging machine which has overcome the shortcomings of the prior art and provides a fully automated pharmaceutical product packaging device capable of selectively depositing one or more different solid pharmaceutical products into individual cavities of an overall package for each of a plurality of individual product package cavities. The system set forth herein is a fully automated machine that is computer controlled and employs a plurality of solid pharmaceutical product dispensing canisters. Each of the canisters are arranged in bays or arrays and the individual solid pharmaceutical dispensing canisters are capable of selectively dispensing a predetermined number of solid pharmaceutical products at any given period of time. The canisters are computer programmable and can be manipulated with a controller. The canisters are capable of selectively filling individual pills into product package cavities regardless of their size or shape and are commercially available.

The system of the present invention employs a plurality of arrays or bays of canisters arranged within a mechanized feeding system. Each bay or array of canisters is designed to feed a corresponding funnel or trough which transmits a solid pharmaceutical product selectively dispensed from one of the canisters in the bay or array into a cavity of a product package template. A plurality of pharmaceuticals may be selected for a single cavity member in a product package template corresponding to each one of the bays or arrays of canisters. The step of filling each of the template cavities is repeated for each of the cavities in the templates that correspond with cavities in a single sheet or card of cavities that provide a patient's dosing requirements for a given period of time.

In one embodiment of the present invention, each of the templates for the respective bays or arrays of canisters is arranged beneath the corresponding funnel or trough for the respective bay or array. In this exemplary embodiment, the templates are each mounted on common X-axis mechanical drive which is capable of selectively positioning each of the cavities from the template under the desired opening in the funnel or trough. This automated positioning allows the selected pharmaceutical from each of the respective bays or arrays to drop down from the canister into its trough and ultimately into the desired template cavity. As noted, the plurality of templates may be filled simultaneously in an embodiment where a single X-Y axis mechanical drive is used to manipulate and selectively position each of the templates.

In an alternate embodiment, a plurality of X-Y axis mechanical drives are provided so that each of the templates corresponding to the respective bay or array of canisters may be independently filled. This may be particularly advantageous where certain bays or arrays of the canisters do not contain medications that are needed in each of the cavities of a given template. For instance, this might occur if a product package contained morning, afternoon and/or evening doses for a given patient. Any given patient's morning dose may be different from the evening doses and depending upon the arrangement of canisters within the various bays, a given bay may only be used to fill a portion of a product package or the template. Therefore, increased efficiency is realized by including a plurality of independently operable X-Y axis drives for each of the templates. Once each of the templates for the respective bays have been filled with the desired combination of drugs, the templates are positioned over a temporary storage template which in turn deposits contents from its cavities into the corresponding cavity of a collector member that receives solid pharmaceuticals from each temporary storage member. The collector member is then positioned over a sheet of clear plastic material containing a plurality of cavities corresponding to the cavities in the templates. A barrier between the cavities in the templates and the sheet of clear plastic material is shifted or moved and the pharmaceuticals in each of the templates are alternately dropped into the corresponding cavities in the clear plastic sheet of material. The clear plastic sheet of material is then maneuvered into subsequent product packaging stations and the templates return to locations beneath the canister.

One additional advantage of using the temporary storage element is that all of the pharmaceuticals in all of the templates may be dropped down as soon as each of the cavities in the template that will be filled, have been filled. This aspect of the invention further increases the versatility and efficiency of the system. Specifically, for example, the system may begin refilling the templates while the collector element is collecting the pharmaceuticals from the temporary stores. As will be shown in more detail below, this is especially true of the alternate embodiment which includes a separate X-Y mechanical drive for each of the respective package templates, because each of these elements can be independently controlled by the system for independent parallel operations. It should be appreciated by those skilled in the art that the temporary storage members are set forth with reference to the applicants preferred embodiments and that the temporary storage members are not necessary for achieving the fundamental benefits of the present invention. Specifically, in an alternate embodiment, the templates could directly feed the collector member without an intermediate drop into the temporary stores.

In an alternate embodiment of the present invention, a bar code reader is employed to read a code from the card or product package immediately after the card has been filled with medication so that the card may be specifically associated with a particular patient dose. Thereafter a label may be printed which identifies the patient and contents of the product package.

DETAILED DESCRIPTION OF THE PREFERRED EMBODIMENTS

Figure 1:
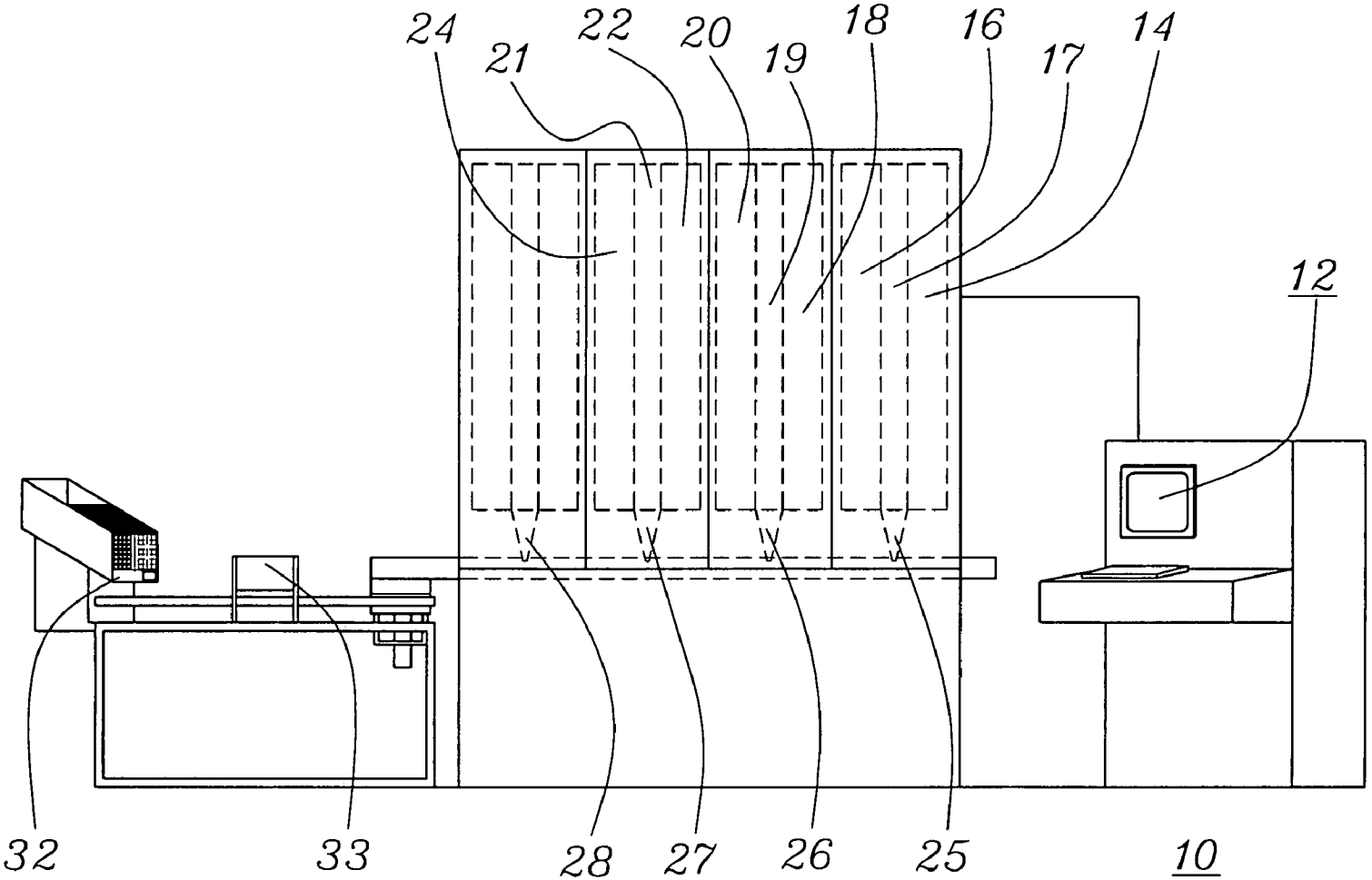
FIG. 1 is a side view illustration of an exemplary embodiment of the present invention.

FIG. 1 illustrates a first exemplary embodiment of the present invention which is shown generally at 10. As shown in FIG. 1, an automated pharmaceutical product packaging machine is controlled by a computer 12 which is linked to each of a plurality of controllable devices through a data bus which is not shown for the sake of convenience. FIG. 1 also illustrates a plurality of banks of solid pharmaceutical product dispensers 14,16,18,20,22, and 24. Each of the banks or arrays of solid pharmaceutical product dispensing mechanisms feeds a corresponding funnel or trough 17,19,21. As shown in the illustration, a single trough is positioned between two adjacent columns of solid pharmaceutical product dispensers. Those skilled in the art will appreciate that the solid pharmaceutical product dispensers are commercially available such as, for example, through Tosho Corporation of Japan.

Additionally, it will be recognized by those skilled in the art that the specific arrangement and relationship between the columns, banks or arrays of the solid pharmaceutical product dispensers and the funnel or trough is purely a matter of design choice. All that is necessary is that the canisters each respectively feed a trough so that the solid pharmaceutical will pass through the trough as desired and ultimately to a funnel portion of the troughs 25,26,27,28. FIG. 1 also illustrates a feed mechanism 32 for feeding solid pharmaceutical product package cards into the packaging machine and a sealing station 33 which will be described in more detail below.

Figure 2:
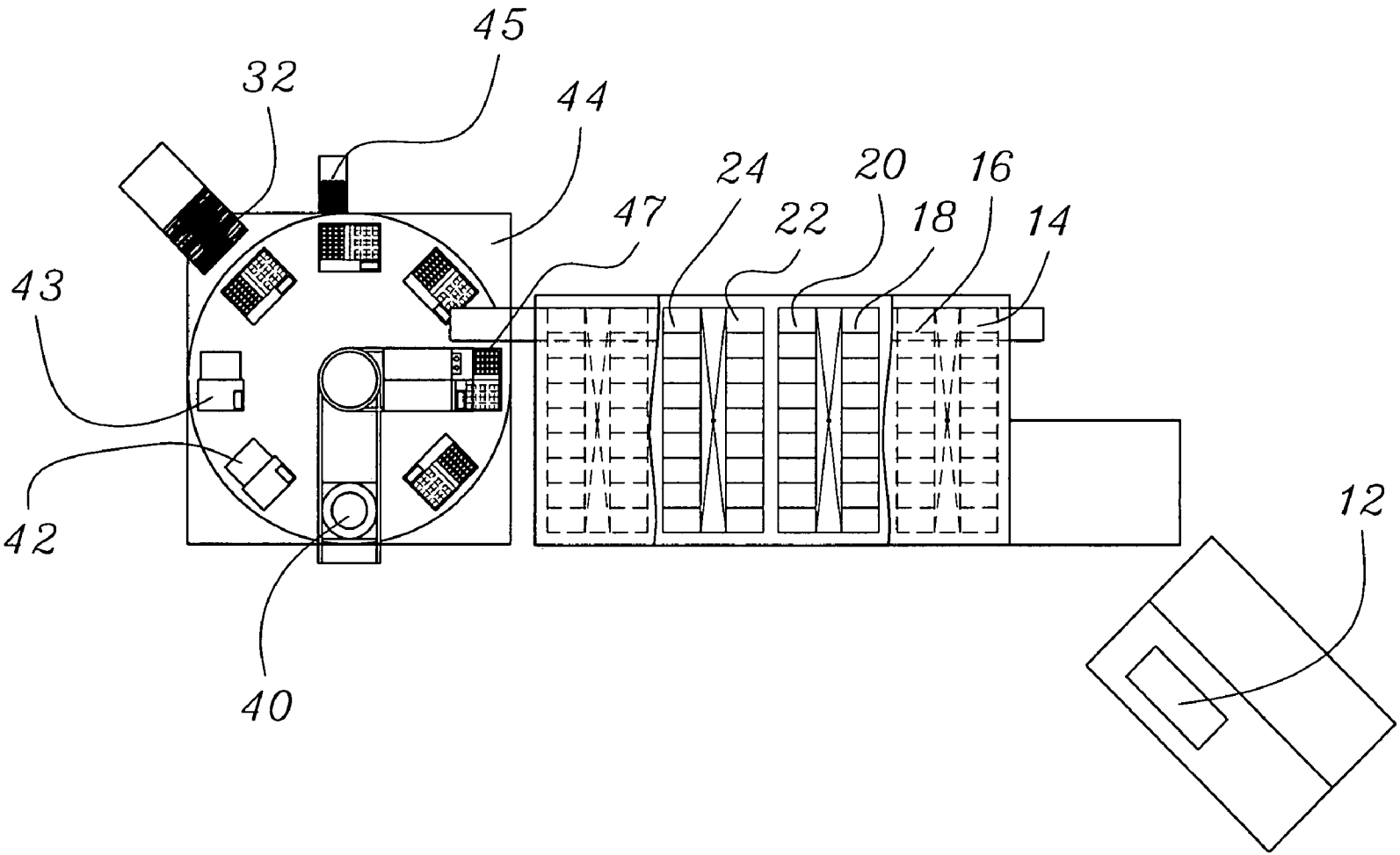
FIG. 2 is a top plan view of the embodiment of the present invention illustrated in FIG. 1.

FIG. 2 is a top plan view illustrating the solid pharmaceutical packaging device of the present invention. The computer controller is shown at 12 and the respective banks, bays or arrays of solid pharmaceutical dispensing canisters are shown at 14,16,18,20,22,24. FIG. 2 also illustrates the product package sealing station 40 which may be of conventional design which is adjacent to a package review station 42 where bar code verification may take place. This station, in turn, is adjacent to product removal station 43. The filling process begins with card dispensing unit 32 which drops a card onto a rotary station 44. A clear plastic blister dispenser 45 adjacent the card dispenser 32 dispenses a clear plastic sheet of material having a plurality of cavities stamped therein. The card with the plurality of clear plastic cavities is maneuvered to station 47 wherein a template is used to simultaneously deposit solid pharmaceuticals from corresponding cavities within the template into the respective cavities in the solid pharmaceutical product package. This will be described in more detail below.

Figure 3:
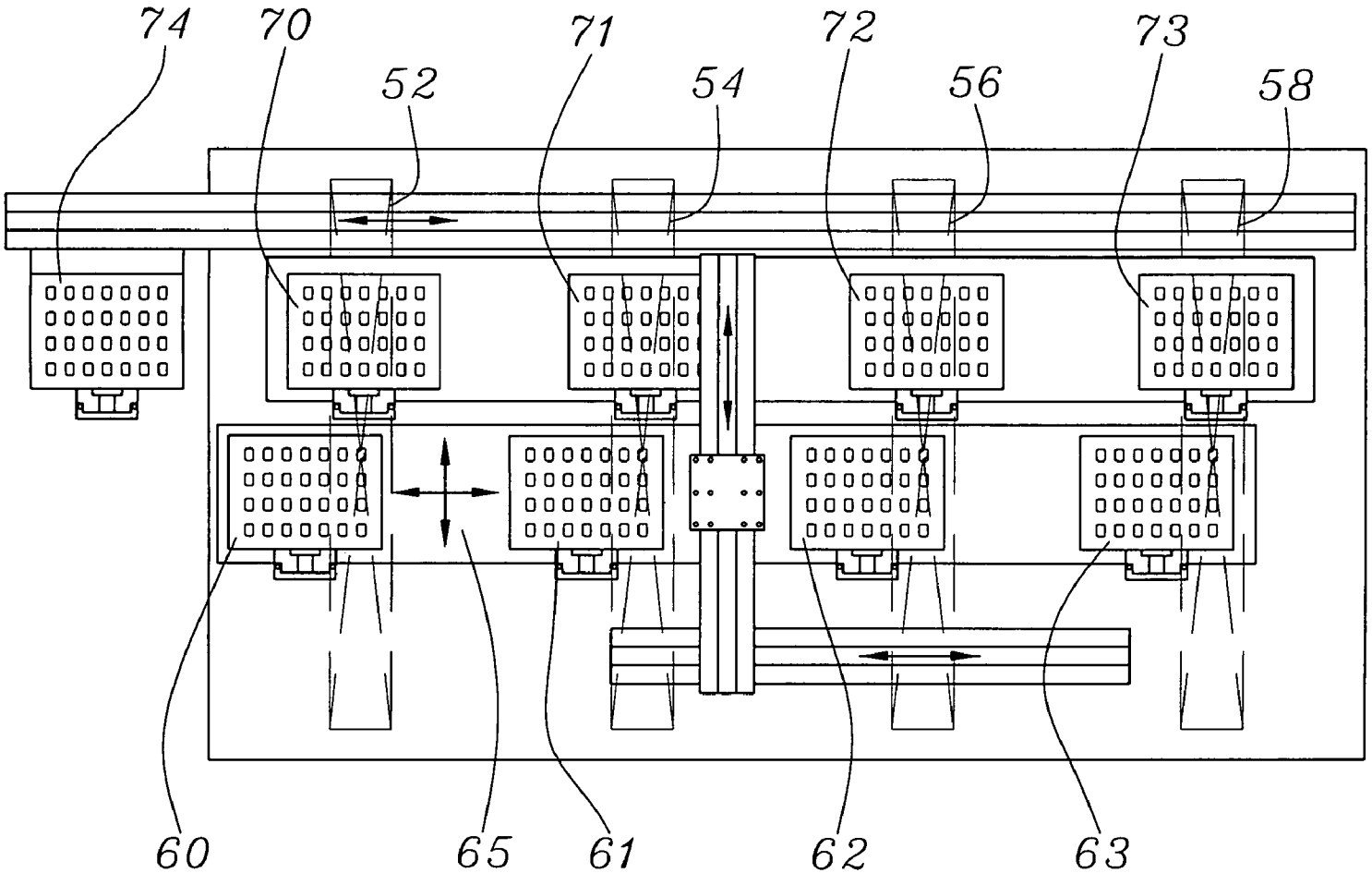
FIG. 3 is a top plan view of an embodiment of the parallel feed mechanism of the present invention having a single X-Y axis mechanical drive.

FIG. 3 illustrates a first exemplary embodiment of the present invention wherein the filling mechanism is shown in detail. In this exemplary embodiment, the funnels or troughs described above which are fed by the plurality of canisters are shown as intersecting dotted lines 52,54,56 and 58. As shown in this drawing, the funnels each are respectively aligned with a template cavity that is located in the upper rightmost location in each of the cavities of product package templates 60,61,62,63. As shown in this illustration, each of the product package templates 60,61,62 and 63 are respectively mounted on a single X-Y axis mechanical drive table 65.

Because each of these templates are mounted on a single drive mechanism, the system is more efficient and also less expensive because multiple drive mechanisms are unnecessary. The same precision may be achieved for each of the template cavities because they are mounted on a single drive mechanism 65. In the preferred embodiment, the drive mechanism is maneuvered by a plurality of pressurized air driven pistons which may in turn be powered by a compressor. It has been found that these air pistons provide the required accuracy in maneuvering the X-Y drive bed 65.

The X-Y drive is positioned so that each of the respective cavities for each of the respective templates 60,61,62 and 63 may be filled as desired by solid pharmaceuticals which drop from the dispensing canisters located in the corresponding bays associated with the respective funnels or troughs 52,54, 56 and 58. When the X-Y drive mechanism 65 has positioned each of the desired cavities under the funnel orifice, the drive mechanism then maneuvers the templates 60,61,62 and 63 over temporary storage templates 70,71,72 and 73.

The temporary storage templates are fixed in position and provide a temporary storage for the solid pharmaceuticals previously contained in product package templates 60,61,62 and 63. A solid pharmaceutical collector 74 has a plurality of cavities which correspond with the cavities in the temporary storage members 70,71,72 and 73. A horizontal drive mechanism traverses the collector member 74 sequentially beneath each of the temporary storage members. As is known in the art, a bottom plate member, not shown, slides out of position to allow each of the pills to drop from the cavities in members 70,71,72 and 73 into the corresponding cavities in collector member 74 when the collector member is positioned directly beneath each of the temporary storage members. As noted, this is simply accomplished by sliding a plate that has a plurality of openings corresponding to the cavities in the temporary store members such that the openings, in the plate are positioned beneath the cavities thereby allowing the solid pharmaceuticals to drop from the temporary storage members into the collector member 74.

Collector member 74 similarly has a bottom plate member which in the first position acts as a barrier to prevent the solid pharmaceuticals from dropping out of their respective cavities in the collector member 74. Collector member 74 is then positioned over the solid pharmaceutical product package and the solid pharmaceutical doses that have been collected by the collector member 74 are then dropped into the corresponding cavities in the product package as is known in the art.

One additional advantage of using the temporary storage elements is that all of the pharmaceuticals in all of the templates may be dropped down as soon as each of the cavities in the template that will be filled, have been filled. This aspect of the invention further increases the versatility and efficiency of the system. Specifically, for example, the system may begin refilling the templates while the collector element is collecting the pharmaceuticals from the temporary stores. As will be shown in more detail below, this is especially true of the alternate embodiment which includes a separate X-Y mechanical drive for each of the respective package templates, because each of these elements can be independently controlled by the system for independent parallel operations. This aspect of the system further enhances the overall efficiency of the system. It should be appreciated by those skilled in the art that the temporary storage members are set forth with reference to the applicants preferred embodiments and that the temporary storage members are not necessary for achieving the fundamental benefits of the present invention. Specifically, in an alternate embodiment, the templates could directly feed the collector member without an intermediate drop into the temporary stores.

In an alternate embodiment of the present invention, a bar code reader which is not shown is employed to read a code from the product package card or package immediately after the card has been filled with medication so that the card may be specifically associated with a particular patient dose. Thereafter a label specific to that package may be printed which identifies the patient and contents of the product package. The label can then be attached to the product package. By immediately associating the package with the specific medications that have been inserted into the card, a number of possible errors in labeling can be eliminated. For example, in the past when a bar code reading step was not applied immediately after the medications are inserted into the package, it was possible that the package could be labeled incorrectly if the package was inadvertently dropped or otherwise separated from the packages associated with a particular patient. By swiping a bar code immediately after filling, the system is able to know precisely which medications have been inserted into the particular package.

Figure 4:
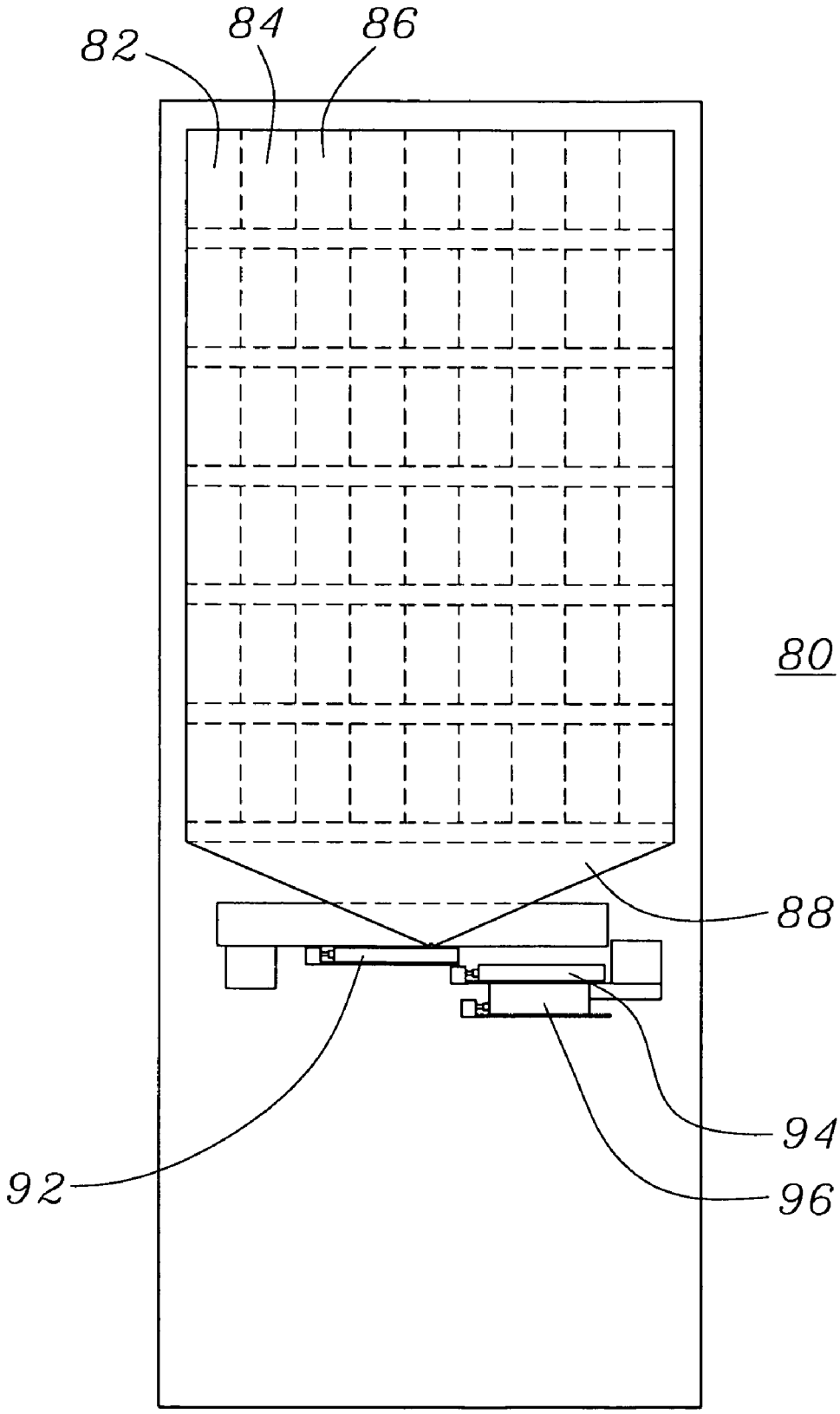
FIG. 4 is a side view of an exemplary embodiment of the plural canister feeding mechanism.

FIG. 4 illustrates a side view of a single bay or array of canister dispensers shown generally at 80. As shown in FIG. 4, a plurality of rows of individual canister dispensers 82,84, 86 feed a common mechanical trough or funnel 88. The trough or funnel feeds a template 92 which provides precise mechanical positioning of the template in an X-Y plane so that each of the cavities in the template may be filled. Template 92 is subsequently positioned over temporary store 94 and is thereafter dropped into collector member 96. In dropping the pharmaceuticals from the template member to the temporary store and collector member, each drop is provided by simply sliding a bottom plate member having a plurality of holes corresponding to each of the cavities in the template located there above. By sliding the plate member, the pharmaceuticals contained therein are allowed to simply drop a gravity feed into the corresponding cavities aligned beneath each member.

Figure 5:
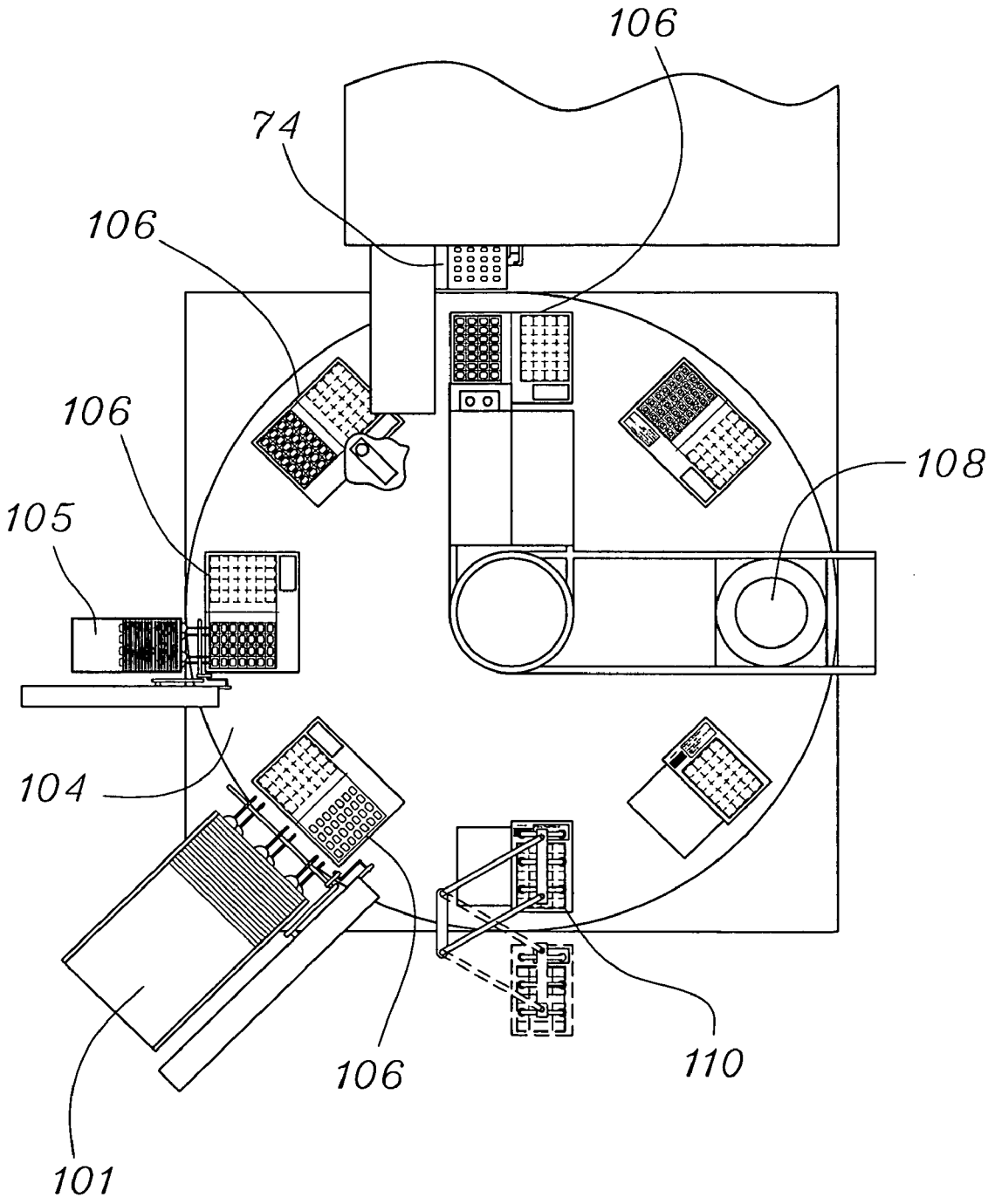
FIG. 5 is a top plan view that illustrates the post filling package processing stations of an exemplary embodiment.

FIG. 5 illustrates remaining stations in the pharmaceutical product package filling machine. In a first station 101, a plurality of cards are fed onto a rotating table member 104. The table member rotates and the card is positioned beneath a clear plastic cavity sheet dispenser 105. The card and sheet combination is then positioned beneath collector member 74 which in the illustration is shown as it is traversing to the position directly above the card member. Once the card is positioned directly beneath the collector member 74, the pharmaceuticals contained therein are allowed to drop into the respective cavities in the card. Station number 108 is a heat sealing station which is known in the art. Subsequent to the heat sealing station, the card is removed from the packaging station via suction arms as shown in station 110. It will be appreciated that a package label printing station may be included in any desired location. As noted above, by including a bar code on the card which is swiped immediately after filling, it is possible to ensure that the appropriate label is printed on the card by reading the bar code prior to printing so that the correct label may be applied.

Figure 6:
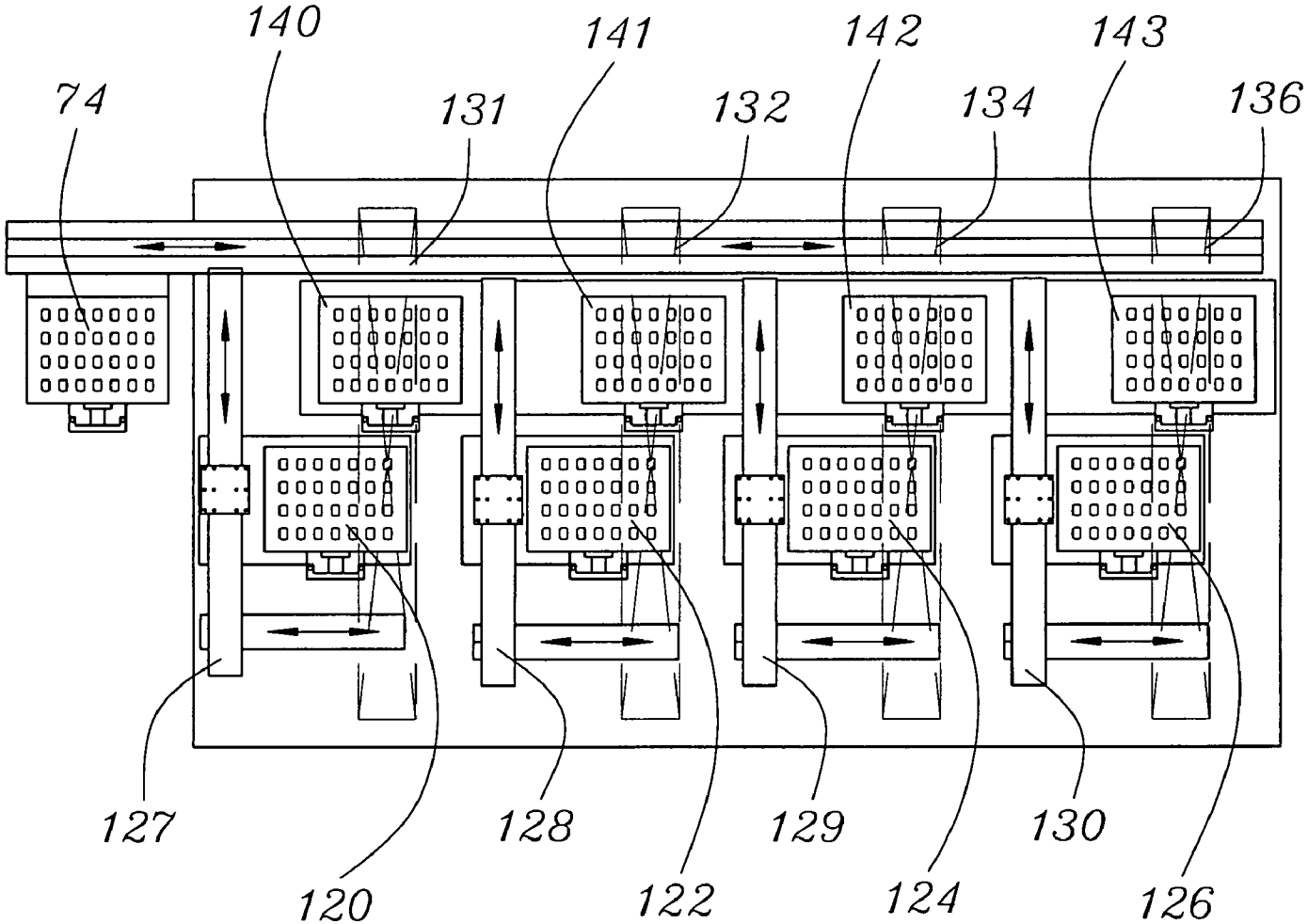
FIG. 6 is a top plan view of an embodiment of the parallel feed mechanism of the present invention having multiple X-Y axis mechanical drives.

FIG. 6 illustrates an alternate preferred embodiment of the present invention. As shown in FIG. 6, in an alternate preferred embodiment of the present invention, each of a plurality of product package templates 120,122,124,126 are respectively associated with corresponding X-Y mechanical manipulators which each operate independently to position a desired cavity of the template beneath the desired funnels which in the illustration are shown as intersecting dotted lines 131,132,134,136. This alternate arrangement of the present invention provides for a greater speed and efficiency through the use of additional X-Y axis manipulators. This is particularly advantageous when a pharmaceutical products contained in one bay may not be utilized in an entire row or column a given product package. This allows the filling to take place more efficiently by only positioning the template cavities that need to be filled with pharmaceuticals from a particular bank or array of associated canisters.

The template is then positioned over temporary storage member as in the prior embodiment and the temporary storage member's cavities are then respectively filled with any pharmaceuticals from the templates. The temporary storage members 140,141,142 and 143 then each sequentially fill the corresponding cavities in collector member 74 as described above.

The present invention is subject to many variations, modifications and changes in detail. For example, it is contemplated that any of a variety of mechanical positioning systems may be utilized and still fall within the scope of the presently claimed invention. Those skilled in the art will appreciate that other modifications and variations in structure will still fall within the scope of the appended claims.

We claim:

1. A method for dispensing solid pharmaceutical products to a product package having a plurality of cavities comprising the steps of:

providing a template having a plurality of cavities corresponding to a plurality of product package cavities;

providing a temporary storage member having a plurality of cavities corresponding to a plurality of product package cavities;

selectively dispensing one or more solid pharmaceutical products from a plurality of different drug sources into a passageway which transmits one or more solid pharmaceutical products from the plurality of different drug sources into each of said plurality of template cavities;

substantially simultaneously transferring the solid pharmaceutical products from said plurality of template cavities to said plurality of temporary storage member cavities; and transferring the solid pharmaceutical products from said plurality of temporary storage member cavities to a further array of cavity locations, wherein the pharmaceuticals are transferred substantially simultaneously from a plurality of template cavities into a corresponding plurality of temporary storage member cavities which are located beneath the template; and further wherein cavities of the template are being filled while the pharmaceuticals located in the further array of cavity locations are being transferred for further automated processing.

2. The method of claim 1, wherein said template includes a bottom plate having a plurality of apertures corresponding to said plurality of product package cavities and wherein said step of transferring the solid pharmaceuticals from said plurality of template cavities includes sliding said bottom plate relative to said template to transfer the solid pharmaceutical products from said plurality of template cavities to said plurality of temporary storage member cavities.

3. The method of claim 1, further comprising the step of:

providing a collector member comprising a plurality of cavities corresponding to a plurality of product package cavities; and wherein the solid pharmaceutical products are transferred to said plurality of cavities of said collector member prior to transferring the solid pharmaceutical products to the product package cavities.

4. The method of claim 3, wherein said temporary storage member includes a bottom plate having a plurality of apertures corresponding to said plurality of product package cavities and wherein said step of transferring the solid pharmaceuticals from said plurality of temporary storage member cavities includes sliding said bottom plate relative to said temporary storage member to transfer the solid pharmaceutical products from said plurality of template cavities to said plurality of temporary storage member cavities.

5. The method of claim 3, wherein said step of selectively dispensing further includes providing relative motion in two generally perpendicular directions between said template and said funnel to selectively locate said funnel over individual ones of the cavities of said template.

6. An automated pharmaceutical product packaging machine for dispensing solid pharmaceuticals into a product package having a plurality of cavities comprising:

a plurality of dispensers containing solid pharmaceuticals;

a passageway which transmits pharmaceuticals from said dispensers;

a template comprising a plurality of cavities corresponding to the plurality of cavities of the product package, wherein the plurality of cavities of the template are arranged in an array and the template receives pharmaceuticals transferred from the dispensers;

a temporary storage member, said temporary storage member comprising a plurality of cavities corresponding to the plurality of cavities of the product package for receiving pharmaceuticals from said template; and wherein pharmaceuticals are substantially simultaneously transferred from said template to corresponding cavities of said temporary storage member and from said temporary storage member to a further array of cavity locations, the pharmaceuticals being transferred substantially simultaneously from the plurality of template cavities into a corresponding plurality of temporary storage member cavities which are located beneath the template; and further wherein cavities of the template are being filled while the pharmaceuticals located in the further array of cavity locations are being transferred for further automated processing.

7. The automated pharmaceutical product packaging machine of claim 6, wherein a bottom plate of said template includes a plurality of apertures corresponding to said plurality of cavities and wherein said bottom plate is slidingly engaged with said template to align said plurality of apertures with said plurality of cavities.

8. The automated pharmaceutical product packaging machine of claim 6, wherein a bottom plate of said temporary storage member includes a plurality of apertures corresponding to said plurality of cavities and wherein said bottom plate is slidingly engaged with said temporary storage member to align said plurality of apertures with said plurality of cavities.

9. The automated pharmaceutical product packaging machine of claim 6, further comprising a collector member comprising a plurality of cavities corresponding to a plurality of product package cavities for receiving pharmaceuticals from said temporary storage member.

10. The automated pharmaceutical product packaging machine of claim 9, wherein a bottom plate of said collector member includes a plurality of apertures corresponding to said plurality of cavities and wherein said bottom plate is slidingly engaged with said collector member to align said plurality of apertures with said plurality of cavities.

11. The automated pharmaceutical product packaging machine of claim 6, wherein relative motion is provided in two generally perpendicular directions between said template and said funnel to selectively locate said funnel over individual ones of the cavities of said template.

* * * * *